United States Patent [19]

Maier, II et al.

[11] Patent Number: 5,043,574

[45] Date of Patent: Aug. 27, 1991

[54] NEUTRAL PARTICLE BEAM SENSING AND STEERING

[75] Inventors: William B. Maier, II; Donald D. Cobb; Richard T. Robiscoe, all of Los Alamos, N. Mex.

[73] Assignee: The United States of America as represented by the United States Department of Energy, Washington, D.C.

[21] Appl. No.: 574,979

[22] Filed: Aug. 30, 1990

[51] Int. Cl.[5] ..... H05H 3/00

[52] U.S. Cl. ..... 250/251; 250/397

[58] Field of Search ..... 250/251, 423 P, 397; 356/121

[56] References Cited

U.S. PATENT DOCUMENTS

| | | | |
|---|---|---|---|
| 3,435,214 | 3/1969 | Bernstein et al. | 250/251 |
| 4,762,993 | 8/1988 | Moses | 250/251 |
| 4,896,032 | 1/1990 | Ball et al. | 250/251 |

*Primary Examiner*—Jack I. Berman
*Assistant Examiner*—Kiet T. Nguyen
*Attorney, Agent, or Firm*—Ray G. Wilson; Paul D. Gaetjens; William R. Moser

[57] ABSTRACT

The direction of a neutral particle beam (NPB) is determined by detecting Lyα radiation emitted during motional quenching of excited H(2S) atoms in the beam during movement of the atoms through a magnetic field. At least one detector is placed adjacent the beam exit to define an optical axis that intercepts the beam at a viewing angle to include a volume generating a selected number of photons for detection. The detection system includes a lens having an area that is small relative to the NPB area and a pixel array located in the focal plane of the lens. The lens viewing angle and area pixel array are selected to optimize the beam tilt sensitivity. In one embodiment, two detectors are placed coplanar with the beam axis to generate a difference signal that is insensitive to beam variations other than beam tilt.

7 Claims, 5 Drawing Sheets

NEUTRAL PARTICLE BEAM SENSING AND STEERING

BACKGROUND OF INVENTION

This invention relates generally to neutral particle beams and, more particularly, to nonintrusive methods and apparatus for sensing and steering neutral particle beams. This invention is the result of a contract with the Department of Energy (Contract No. W-7405-ENG-36).

Neutral particle beams (NPB's) are high energy beams of hydrogen (H) atoms formed by accelerating hydrogen ions in an accelerator and then neutralizing the ions during exit from the accelerator. NPB's have a variety of possible applications in medicine and in heating fusion plasmas, as well as weapons applications for deployment in space. A fundamental requirement for useful applications is the ability to direct the beam in a desired direction, particularly where it is difficult to detect and measure neutral particles.

Various techniques have been used to determine the direction of NPB's, all of which have been active and/or intrusive. Laser beams have been used in a Doppler-shift system and to excite the H atoms for subsequent radiation and detection, but such systems are difficult to operate. One intrusive technique uses only the periphery of the beam, but fails to obtain information on the beam interior. Another technique employs two or more wires that intercept the beam at different axial locations to obtain directional information. In yet another technique residual charged particles in the beam are deflected at a known angle from the beam wherein the direction of the charged particles can be measured with concomitant information on the NPB direction. See U.S. Pat. No. 4,762,993, issued Aug. 6, 1988, to K. Moses.

In accordance with the present invention, the direction of a NPB is determined by passively detecting photons emitted from excited H(2S) atoms in the beam that decay when motionally quenched in a magnetic field, e.g., during passage through the earth's magnetic field.

It is an object of the present invention to provide a highly sensitive system for determining the direction of a NPB relative to a reference platform.

It is another object to sense a NPB using a characteristic inherent in the NPB along the direction of beam propagation.

It is one other object to provide only passive detectors for sensing a selected beam characteristic having directional information.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise an accelerator for emitting a neutral particle beam along a predetermined axis in a magnetic field effective to motionally quench H(2S) atoms for emitting Ly$\alpha$ radiation. At least one optical system is spaced from the beam axis a predetermined distance with an optical axis intersecting the beam axis at a viewing angle to include sufficient photons from the Ly$\alpha$ radiation to form a signal at least above the shot noise limit. A detector array is placed in the focal plane of the optical system to convert the photons to a signal functionally related to the direction of the beam axis.

In one embodiment, at least two optical systems are disposed at locations 180° apart about the beam where the difference signal between the array outputs forms a sensitive measure of beam direction variations in the plane defined by the optical system axes. Four optical systems can be disposed at 90° intervals about the beam to detect variations in two orthogonal planes.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

In accordance with the present invention, a neutral particle beam (NPB) includes H atoms in an excited state which emit radiation that can be detected to provide a sensitive measure of beam direction. An optical system has a small viewing angle along the NPB axis to provide a spatial resolution compatible with beam pulse lengths and an adequate sensitivity to small beam tilts from a predetermined direction. For nominal beam parameters and a detector optical system at an optimum viewing angle of 0.5–0.6 mrad, the spatial response allows a tilt of about 50 $\mu$rad to be detected.

When a NPB is formed, a significant fraction of the neutral hydrogen atoms is in excited states and forms a strong source of hydrogen emission lines. Monitoring these lines by means of suitable photometers situated on the NPB platform and viewing the beam in flight can provide information on the beam: measurements of the beam energy by Doppler shift, sampling the instantaneous beam current by signal variations within a NPB pulse, and providing beam steering corrections from pulse-to-pulse signal variations.

The hydrogen emission line chosen for such NPB monitoring must meet at least three criteria (1) the emitting state must be produced abundantly during stripping, (2) the state must live long enough to emit useful signals from tens of meters of beam length, and (3) the emission line should be in a relatively quiet region of the background radiation spectrum. Ly$\alpha$ radiation at 1216 angstroms from the excited H(2S) state adequately meets these criteria. The beam contains initially about 7% H(2S) and the emitted radiation is in a quiet region of background solar radiation. Further, the H(2S) state is metastable and decay is induced by motion through the earth's magnetic field, with a minimum decay length $\lambda$ of 23.2 m at a beam energy of 20 MeV, where the excited atoms emit at 1% of their original intensity even after 100 m of beam travel. It should be noted that the emitted radiation detected by a stationary detector located behind the beam will be Doppler red-shifted to a wavelength of about 1494 angstroms at small viewing angles.

Figure 1:
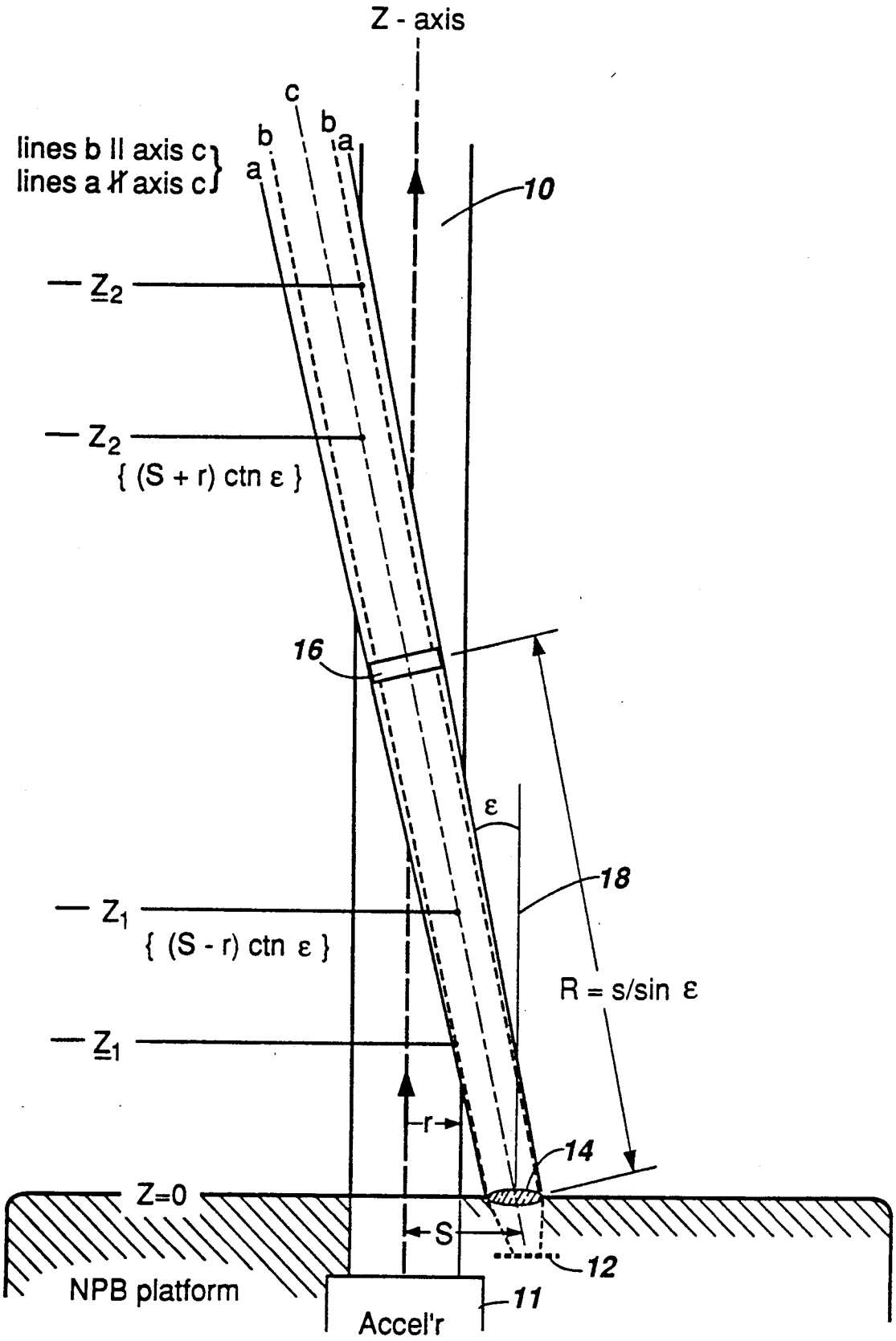
FIG. 1 illustrates in pictorial form one embodiment of the beam sensing system according to the present invention.

Referring now to FIG. 1, there is shown a pictorial illustration of a NPB sensing system for sensitively determining variations in beam tilt by detecting Ly$\alpha$ radiation. NPB 10 is emitted by accelerator 11 from a fixed platform. Pixel array 12 detects photons from emitting volume 16 that are collected by lens 14 and focused in the plane of pixel array 12. Lens 14 has a diameter d, a focal length f, area $A_L$, and observes emitting volume 16 over a cross-sectional area $A_b=\pi r^2$, where r is the radius of beam 10. Assume a pixel of area $a_p$ is located in focal plane of lens 14 whereby a point at the center of $a_p$ will be illuminated by light originating in the region between lines b and emitted parallel to line c, the central axis of the pixel field-of-view (FOV), $\Delta\epsilon$. Assume that $A_L << A_b$ so that the intersections $z_1$ and $z_2$ on the edges of the detector FOV are close to intersections defined by $z_{2,1}=(s\pm r)\mathrm{ctn}\epsilon$, i.e., the beam radiation rate does not change significantly between $z_1$ and $z_1$ or between $z_2$ and $z_2$. Since $\Delta z/\lambda \approx d/2\epsilon\lambda$ for these regions, for $\lambda=23.2$ m, $\Delta z/\lambda$ remains small down to $\epsilon \approx 1$ mrad and $d \approx$ few cm.

Define an emitting volume element in the beam by $$dV_b = Adl = Adz/\cos\epsilon,\ A = A_L\cos\epsilon + R^2\Delta\omega, \tag{1}$$

where dl is an element of length parallel to line c and A is the cross-sectional area between lines a. The volume element $dV_b$ now has two parts: a lens contribution and the FOV contribution. Photons emitted from these two regions must be treated differently. To be focused on the pixel area $a_p$, a photon emitted inside $(A_L\cos\epsilon)dl$ must travel toward the lens and remain approximately within a solid angle $\Delta\omega=a_p/f^2$ centered on a line parallel to the c axis, provided that $A_L\cos\epsilon > R^2\Delta\omega$. A photon emitted inside $R^2\Delta\omega dl$ must travel toward the lens within a solid angle $\Delta\Omega=(A_L\cos\epsilon)/R^2$ to be focused on $a_p$. When $A_L\cos\epsilon > R^2\Delta\omega$, the photon must be emitted approximately within the solid angle $(A_L\cos\epsilon)/R^2$, subtended by the lens at the point of emission, to be focused on the pixel.

In one viewing geometry, $A_L\cos\epsilon > R^2\Delta\omega$ for $R<227$ m, by which distance the Ly$\alpha$ radiation has decreased considerably. The photon current on the pixel is then approximately $$d\dot{P} \simeq J[(A_L\cos\epsilon)\Delta\omega + (A_L\cos\epsilon/R^2)R^2\Delta\omega]dl = (2A_L\Delta\omega)Jdz, \tag{2}$$

where $J=d^2S/dtdV_b\Delta\Omega$ denotes the volume emittance.

It can be shown that the photon current through the lens can be represented as $$\dot{P} = 2(A_L/A_b)\Delta\omega\left[\frac{\mu I(t)}{4\pi}/\gamma 2(1-\beta\cos\epsilon)^2\right]\{e^{-z1/\lambda} - e^{-z2/\lambda}\}. \tag{3}$$

$\dot{P}=dP/dt$ is the number of photons per unit time reaching a lens 14 of area $A_L$ and FOV $\Delta\omega$. The following definitions apply to the terms in equation (3):

$\mu$ NPB H(2S) fraction $\gamma$ $1/\sqrt{(1-\beta^2)}$, dilation factor $\beta$ $v/c$, NPB velocity.

As shown in FIG. 1, the beam axis-lens axis separation is s, the beam radius is r, and s>r for placement of the lens 14 outside beam 10. If lens 14 were placed to look directly down the axis of beam 10, then $z_1=0$, $z_2=\infty$, and $\epsilon=0$. This yields the maximum possible photon current $$\dot{P}_M = \left(\frac{a\Delta\omega}{A_b}\right)\left[\frac{\mu I(t)}{4\pi}\ \frac{1-\beta}{1-\beta}\right]. \tag{4}$$

$$\dot{P} = \dot{P}_M\left(\frac{1-\beta}{1-\beta\cos\epsilon}\right)^2 g(\epsilon;\lambda,s,r). \tag{5}$$

$$g = 2\exp[(-s/\lambda)\mathrm{ctn}\epsilon]\sinh[(r/\lambda)\mathrm{ctn}\epsilon] \tag{6}$$

The maximum signal is thus adjusted by a peaking factor, and it is diminished by the geometry factor $g(\epsilon)$.

A signal change $\Delta P$ for a given beam tilt $\Delta\psi$ is governed by the geometry factor $g(\epsilon)$ in Equation (6), and that change is quite sensitive to $\Delta\psi$ when the beam is viewed near its limb ($\epsilon\rightarrow 0$). At small viewing angles, $\epsilon<10°$, the factor containing $\beta$ in Equation (2) is unity to better than 1% and the photon current can be written as $$\dot{P}(z_1,z_2) = \dot{P}_M g(z_1,z_2),\ g = [e^{-z1/\lambda} e^{-z2/\lambda}] \tag{7}$$

A change in beam direction will change the intercept points $z_{1,2}$ of the lens FOV with the beam edges with a resulting incremental change in the detected photon current, P. This incremental change can be expressed as $$\Delta\dot{P}/\dot{P} \simeq -(1/g)[(\Delta z_1/\lambda)e^{-z1/\lambda}] \tag{8}$$

Equations (7) and (8) show that the geometry factor g and its derivatives control P and $\Delta P$. For a very small angle $\epsilon$, Equation (6) can be written as $$g(\epsilon) = 2\exp(-\sigma/\epsilon)\sinh(\rho/\epsilon), \tag{9}$$

where $$\rho = r/\lambda,\ \sigma = s/\lambda,\ \rho<\sigma<<1.$$

The quantities $\rho$ and $\sigma$ are, respectively, the NPB radius and detector position in units of decay length $\lambda$, with the ordering chosen to satisfy $\sigma<\sigma<<1$. Maximum values for and g are found from the derivative of $g(\epsilon)$ to be $$\epsilon_M = 2\rho/\ln[(\sigma + \rho)/(\sigma - \rho)]; \quad (10)$$

$$g_M = [2\rho/\sqrt{(\sigma^2 - \rho^2)}]\exp\{-(\sigma/2\rho)\ln[(\sigma + \rho)/(\sigma - \rho)]\}.$$

To assess the photon-current sensitivity to a small beam tilt in the plane of the beam-lens axes, note that a clockwise beam-axis shift by $\Delta\psi$ is equivalent to an increase in $\epsilon$ by $\Delta\psi$ and the intersection points change by $$\Delta z_{2,1} = (s \pm r)\Delta \operatorname{ctn}\epsilon = -(s \pm r)(\csc^2\epsilon)\Delta\psi \simeq (s \pm r)(\Delta\psi/\epsilon^2). \quad (11)$$

The approximation of Equation (8) then becomes $$\Delta\dot{P}/\dot{P} \simeq G(\epsilon)(\Delta\psi/\sigma),$$
$$G(\epsilon) = (\sigma/\epsilon)^2[(\sigma/\rho) - \operatorname{ctnh}(\sigma/\epsilon)]. \quad (12)$$

$G(\epsilon)$ is a "gain factor" that is proportional to the derivative of $g(\epsilon)$, i.e., is zero at $g_M$. Then if the detector reads out signals reliably at the level $|\Delta\dot{P}/\dot{P}| \geqq 1/Q$, where Q is the detector signal-to-noise ratio, beam-tilt angles can be detected that are larger than $$|\Delta\psi(\epsilon)|_m = \sigma/Z|G(\epsilon|, \quad (13)$$

where $\epsilon < \epsilon_m$ to provide the largest possible $G(\epsilon)$. From Equation (5), the average number of detector counts during a beam pulse having duration T is $\eta\dot{P}_M T_g$, where $\eta$ is the overall fractional detector efficiency. Then, in the shot noise limit, $Q = (\eta\dot{P}_M Tg)^{\frac{1}{2}}$, and Equation (13) becomes $$|\Delta\psi(\epsilon)|_m = [\rho/(\eta P_M T)^{\frac{1}{2}}]/\{G(\epsilon)\sqrt{g(\epsilon)}\}. \quad (14)$$

An "optimization factor", $D(\epsilon) =$ $$G(\epsilon)\sqrt{g(\epsilon)}\ ,$$

is defined to minimize $|\Delta\psi(\epsilon)|_m$. An optimum operating point for $D(\epsilon)$ can be determined graphically or by approximation to produce the smallest minimum detectable beam tilt angle $|\Delta\psi(\epsilon)|_m$ that can be achieved for a single pixel by detector aiming alone.

Figure 2:
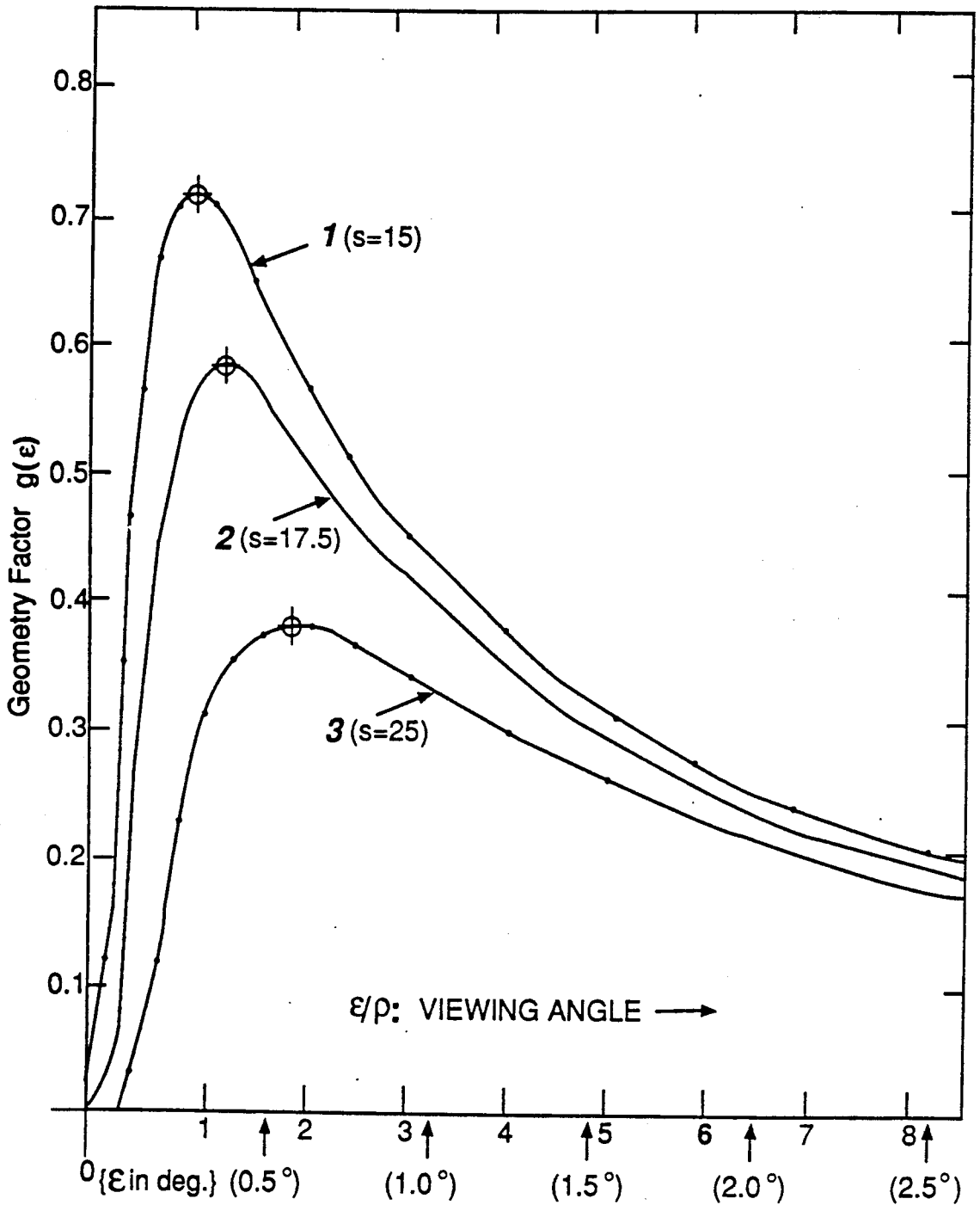
FIG. 2 graphically illustrates the geometry factor of the system shown in FIG. 1 as a function of viewing angle and optical displacement.
Figure 3:
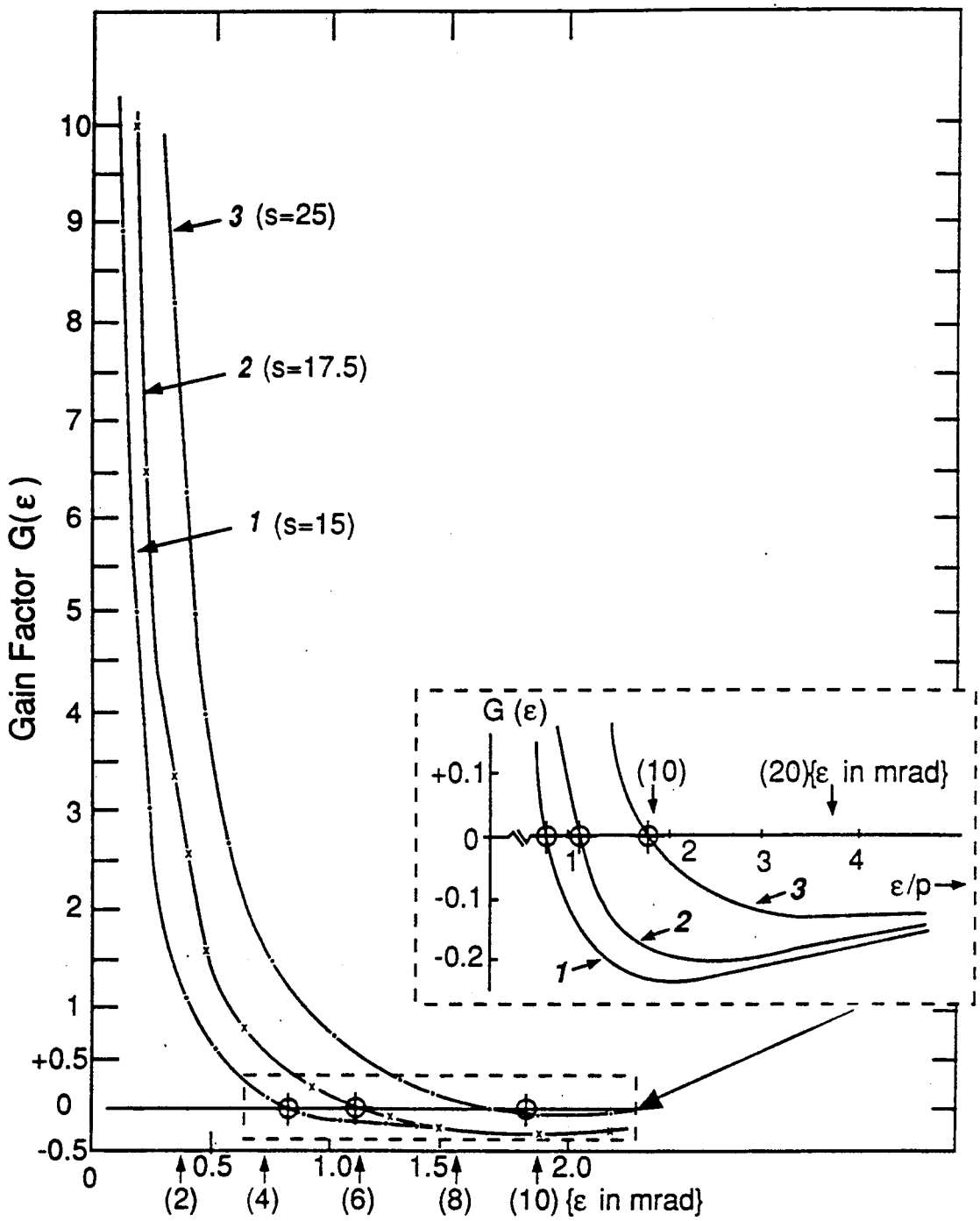
FIG. 3 graphically illustrates the gain factor of the system shown in FIG. 1 as a function of viewing angle and optical displacement.
Figure 4:
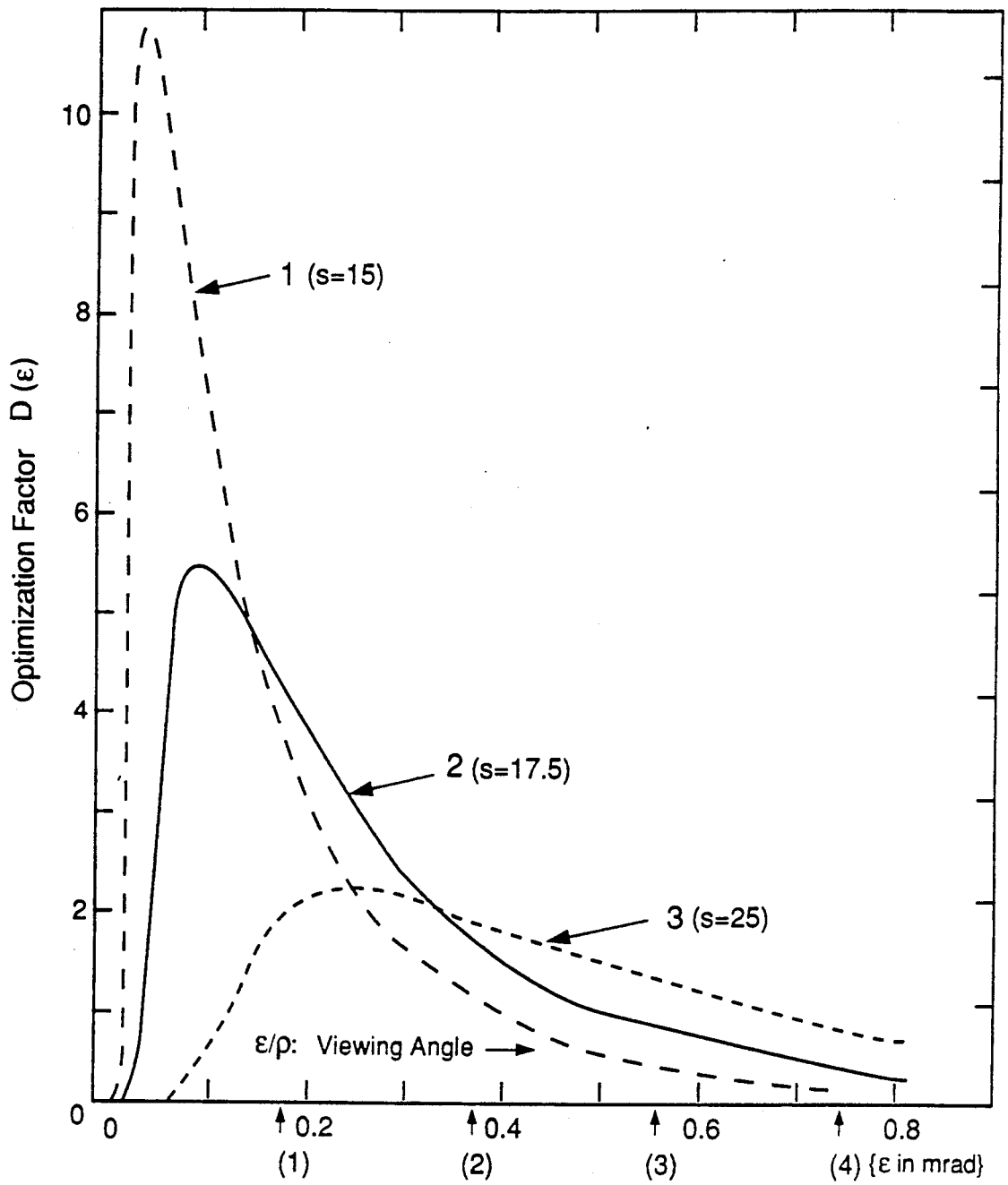
FIG. 4 graphically illustrates the optimization factor of the system shown in FIG. 1 as a function of viewing angle and optical displacement.

FIGS. 2, 3, and 4 graphically depict the geometry factor $g(\epsilon)$, gain factor $G(\epsilon)$, and optimization factor $D(\epsilon)$ for a nominal NPB having the parameters set out in Table A. In each Figure, three cases are presented for different spacings between the NPB axis and the lens axis. In all cases a beam radium $r = 12.5$ cm and H(2S) decay length $\lambda = 23.2$ m are used, with a resulting dimensionless parameter $\sigma = r/\lambda = 5.39$ mrad $= 0.309°$.

FIG. 2 depicts the geometry factor $g(\epsilon)$ vs. detector viewing angle $\epsilon$. The factor $g(\epsilon)$ is the fraction of the maximum possible signal $\dot{P}_M$ that can be attained by a detector placed outside the beam and viewing the beam at angle $\epsilon$. The choice of detector separations shown, i.e., 15, 17.5, and 25 cm, allows for corresponding lens diameters $d \leqq 5, 10, 25$ cm at the beam radius.

TABLE A

NOMINAL NPB OPERATING PARAMETERS

| Parameter | Symbol | Value |
|---|---|---|
| beam energy | K | 20 MeV |
| atom velocity | v | $6.09 \times 10^7$ m/s |
| $\beta = v/c$ | $\beta$ | 0.2032 |
| $\gamma = 1/\sqrt{(1 - \beta^2)}$ | $\gamma$ | 1.0231 |
| beam current | I | 50 mA, avg. |
| pulse length (temporal) | T | 100 $\mu$s |
| pulse length (spatial) | L | 6.09 km |
| no. neutrals per pulse | — | $3.1 \times 10^{13}$ (5 $\mu$C) |
| total energy per pulse | — | 100 J |
| pulse repetition rate | — | 100 Hz (1% duty) |
| beam radius | r | 12.5 cm |
| neutral atom density | — | $1.04 \times 10^5$/cm$^3$ |
| beam H(2S) fraction | $\mu$ | 7% |
| no. H(2S) per pulse | $N_s$ | $2.3 \cdot 10^{12}$ |

FIG. 3 graphically illustrates the gain factor $G(\epsilon)$ for the parameters used in FIG. 2 and set out in Table A. The gain factor is zero where $\epsilon = \epsilon_M$. For high sensitivity, the operating portions of FIG. 3 are $\epsilon < \epsilon_M$, where $G(\epsilon)$ becomes large and positive.

FIG. 4 graphically illustrates the optimization factor $D(\epsilon) =$ $$G(\epsilon)\sqrt{g(\epsilon)}\ .$$

The minimum beam tilt angle $|\Delta\psi|_m$ detectable by a single pixel is smallest when the pixel samples the beam Ly$\alpha$ radiation at a viewing angle $\epsilon$ such the optimization factor is a maximum. The pixel is assumed to be operating at the shot-noise limit. The maxima in $D(\epsilon)$ occur at angles represented by $\epsilon_o \sim (\frac{1}{4})(s - r)/\lambda$ to yield an optimum viewing angle, e.g., of $\epsilon_0/\sigma = 0.2$ or 1.078 mrad on curve 2 ($s = 17.5$ cm).

Figure 5:
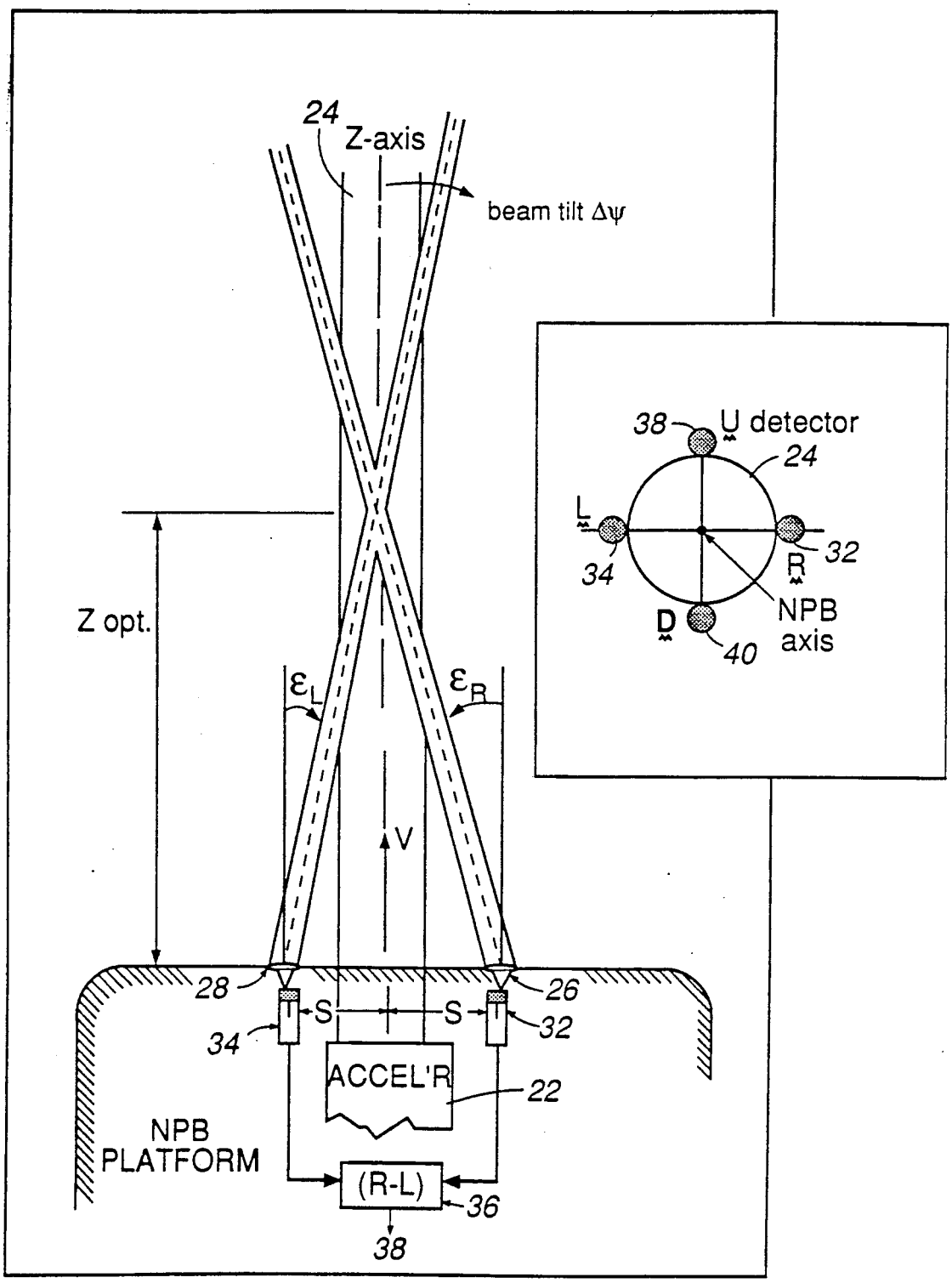
FIG. 5 illustrates in pictorial view on embodiment of the system shown in FIG. 1 with two optical systems.

Referring now to FIG. 5, there is shown accelerator 22 producing NPB 24. Lenses 26 and 28 with corresponding detectors 32 and 34, respectively, have optical axes located in the same plane with the axis of beam 24 and are located on opposite sides of beam 24. Each detector 32, 34 is at a distance s from the beam 24 axis and observes beam 24 at small viewing angles $\epsilon_R$ and $\epsilon_L$ that are about the same, but need not be identical. For a beam 24 radius $r = 12.5$ cm and $s = 17.5$ cm, and both detectors aimed at about the optimum viewing angle $\epsilon_0 \simeq 1.1$ mrad, the detectors 32, 34 FOV's overlap at $z \simeq 2\lambda s/(s - r)$ or about 160 m along the beam 24 axis. A "beam tilt", i.e., angular shift in the NPB axis, by a small angle $\Delta\psi$ in the detector plane increases the Ly$\alpha$ signal in one detector and decreases the signal in the other detector. The output signals from detectors 32, 34 are input to difference amplifier 36 to produce an output signal 38 proportional to the signal difference and, hence, proportional to the beam tilt $\Delta\psi$.

Difference signal 38 is not sensitive to most beam fluctuations that affect the Ly$\alpha$ signal other than beam tilt. Fluctuations in the beam current will change the detected signal, but the changes will be the same for both detectors 32, 34. Similarly, there is no change in output signal 38 with changes in beam energy, i.e., beam velocity v. A uniform change in beam cross-sectional area $A_b$ would produce no change in difference signal 38, although an asymmetric change would be indistinguishable from a beam tilt.

The optimum viewing conditions for detecting beam tilt with two detectors 32, 34 using k pixels, the number of pixels illuminated at viewing angle $\epsilon$ can be shown to be $$\epsilon_0 \simeq (\tfrac{1}{2})(u-1)\rho = (\tfrac{1}{2})(s-r)/\lambda; \quad (15)$$
$$g(\epsilon_0) \simeq 1/e^2 = 0.1353;\ G(\epsilon_0) \simeq 4/(u-1);\ \text{and}$$

$$\{(\epsilon/\rho)G(\epsilon)\sqrt{g(\epsilon)}\}_0 \simeq 2/e = 0.7357.$$

where u=s/r. At $(\epsilon/\sigma)_0=(\tfrac{1}{2})(u-1)$ the number of working pixel pairs, each pixel having an area $a_p$, is $$k \simeq (A_b/4a_p)\frac{f}{\lambda}[1-(r/s)]^2. \quad (16)$$

The minimum detectable beam-tilt angle under the optimum conditions of Equation (15) then becomes $$|\Delta\psi| \geqq (\kappa e/\sqrt{\eta N_s})(s/d)[(1+\beta)/(1-\beta)]^{\frac{1}{2}}, \quad (17)$$

where $\eta$ is the overall detection efficiency for one pixel, $N_s$ is the total number of 2S atoms per beam pulse, s is the detector position with respect to the NPB axis, d is the detector lens diameter, $\beta$ is the NPB velocity, and $\kappa$ is the multiple of detector noise at which the tilt signal becomes apparent For the nominal system values of Table A, $$|\Delta\psi| \geqq 4.77\kappa/\sqrt{\eta}\ \mu\text{rad}. \quad (18)$$

If $\eta$=0.1–0.2 and $\kappa$=1, then $|\Delta\psi| \geqq$15.1–10.7 $\mu$rad.

The two-detector system shown in FIG. 5 is sensitive to beam tilts in the plane of the detectors and little else. To detect beam tilts out of the two-detector plane, a four-detector system may be provided, as shown in FIG. 5. Detectors 32. 34 sense beam tilt in the L-R plane and detectors 38. 40 sense beam tilt in the U-D plane. Detectors 32, 34, 38, 40 are preferably spaced uniformly around beam circumference 24 to define two orthogonal planes L-R and U-D. Table B sets out the nominal parameters for a two-detector beam-tilt sensing scheme according to the present invention.

TABLE B

NOMINAL PARAMETERS FOR TWO-DETECTOR SYSTEM

| Parameter | Optimum Setting | Typical Value |
|---|---|---|
| viewing angle | $\epsilon_o = \frac{1}{2}(u-1)\rho$ | 1.08 mrad |
| geometry factor | $g(\epsilon_o) = 1/e^2$ | 0.1353 |
| gain factor | $G(\epsilon_o) = 4/(u-1)$ | 19 |
| viewing distance | $R = s/\epsilon_o$ | 162 m |
| viewing endpoints | $z_{1,2} = (s \mp r)/\epsilon_o$ | 46.278 m |
| no. of pixels per detector | N | 400 × 400 |
| pixel area | $a_p$ | 25 $\mu$m × 25 $\mu$m |
| pixel field of view | $\Delta\omega$ | $10^{-7}$ sr |
| lens diameter (f/1) | d | 8 cm |
| no. of working pixels (at $\epsilon_o$) | k | 19 |
| working pixel | $N_p = \eta P_s/g$ | 313$\eta$/pulse |

TABLE B-continued

NOMINAL PARAMETERS FOR TWO-DETECTOR SYSTEM

| Parameter | Optimum Setting | Typical Value |
|---|---|---|
| S/N ratio (one pixel) | $Q = \sqrt{N_p}$ | $17.7\sqrt{\eta}$ |
| min. detectable beam tilt | $\lvert\Delta\psi\rvert = (4.8\ \mu\text{rad})/\sqrt{\eta}$ | 10–15 $\mu$rad |

The complete theoretical analysis for the above system is set out by the inventors in R. T. Robiscoe et al., "Onboard Detection of Intrinsic Ly$\alpha$ Radiation from a Neutral Particle Beam," LA-11776-MS, issued May 1990, available from NTIS, and incorporated herein by reference. The foregoing description of the preferred embodiments of the invention have been presented for purposes of illustration and description. It is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for sensing a neutral particle beam direction emitted by an accelerator along a predetermined axis in a magnetic field effective to motionally quench H(2S) atoms for emitting Ly$\alpha$ radiation, comprising:

at least one optical lens effective to transmit said Ly$\alpha$ radiation spaced from said beam axis a predetermined distance and defining an optical axis intersecting the beam axis at a viewing angle to include at least a selected number of photons from said Ly$\alpha$ radiation; and a detector array in the focal plane of said optical lens effective to detect said selected number of photons from the shot noise limit of said array and to convert said photons to a signal functionally related to said direction of said beam axis.

2. Apparatus according to claim 1, wherein the cross-sectional area of said lens is very small relative to the cross-sectional area of said beam.

3. Apparatus according to claim 1, wherein said viewing angle is effective to produce a maximum incremental increase in said photons from a selected change in said beam direction.

4. Apparatus according to claim 1, wherein said viewing angle is less than the value that provides a maximum of $g(\epsilon)=2\exp(-\sigma/\epsilon)\sinh(\rho/\epsilon)$, where $\rho=r/\lambda$, $\sigma=s/\lambda$, $\rho<\sigma<<1$, $\lambda$=23.2 m, r is the radius of said NPB and s is said predetermined spacing of said optical lens.

5. Apparatus according to claim 4, wherein said at least one optical lens is one lens and said selected viewing angle is about $\epsilon_0 \sim (\tfrac{1}{4})(s-r)/\lambda$.

6. Apparatus according to claim 4, wherein said at least one optical lens is two lenses coplanar with said beam axis and said selected viewing angle is about $\epsilon_0 \sim (\tfrac{1}{2})(s-r)/\lambda$.

7. Apparatus according to claim 1, wherein said at least one optical lens is four lenses defining two orthogonal planes along said beam axis.

* * * * *